US009517419B1

(12) United States Patent
Lee et al.

(10) Patent No.: US 9,517,419 B1
(45) Date of Patent: Dec. 13, 2016

(54) PLAYGROUND FOR HANDICAPPED CHILDREN

(71) Applicants: Tre Lisa Lee, Fort Lauderdale, FL (US); Bobby Lee, Fort Lauderdale, FL (US); Trellany Lee, Fort Lauderdale, FL (US)

(72) Inventors: Tre Lisa Lee, Fort Lauderdale, FL (US); Bobby Lee, Fort Lauderdale, FL (US); Trellany Lee, Fort Lauderdale, FL (US)

( * ) Notice: Subject to any disclaimer, the term of this patent is extended or adjusted under 35 U.S.C. 154(b) by 0 days.

(21) Appl. No.: 14/629,654

(22) Filed: Feb. 24, 2015

(51) Int. Cl.
*A63G 9/00* (2006.01)
*A63G 31/00* (2006.01)
*A63G 21/00* (2006.01)

(52) U.S. Cl.
CPC ..... *A63G 31/00* (2013.01); *A63G 9/00* (2013.01); *A63G 21/00* (2013.01)

(58) Field of Classification Search
CPC ..... A63G 31/00
See application file for complete search history.

(56) References Cited

U.S. PATENT DOCUMENTS

| | | | | |
|---|---|---|---|---|
| 3,737,161 | A | 6/1973 | Taylor | |
| 3,888,058 | A * | 6/1975 | Ahrens | E04F 11/112 52/191 |
| 5,161,522 | A | 11/1992 | Clevenger | |
| D382,618 | S * | 8/1997 | Gift | D21/814 |
| 5,803,835 | A * | 9/1998 | Moton | A63B 5/22 473/414 |
| 5,938,283 | A | 8/1999 | Babcock | |
| 6,093,134 | A | 7/2000 | Worsham | |
| D468,386 | S | 1/2003 | Frank | |
| 6,739,876 | B2 | 5/2004 | Ochi | |
| 6,997,815 | B2 * | 2/2006 | Devine | A63G 9/02 472/118 |
| 8,002,642 | B2 * | 8/2011 | Guerzini | A63G 31/00 472/116 |

FOREIGN PATENT DOCUMENTS

CA 2388098 C 4/2007

* cited by examiner

*Primary Examiner* — Michael Dennis

(57) ABSTRACT

The playground for handicapped children is a collection of playground equipment designed for use by handicapped children. The playground for handicapped children comprises a bridge, a slide, a swing set, and a ball pen.

1 Claim, 6 Drawing Sheets

PLAYGROUND FOR HANDICAPPED CHILDREN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of playground and amusement equipment, more specifically, playground equipment for use by handicapped children.

SUMMARY OF INVENTION

The playground for handicapped children is a collection of playground equipment designed for use by handicapped children. The playground for handicapped children comprises a bridge, a slide, a swing set, and a ball pen.

These together with additional objects, features and advantages of the playground for handicapped children will be readily apparent to those of ordinary skill in the art upon reading the following detailed description of the presently preferred, but nonetheless illustrative, embodiments when taken in conjunction with the accompanying drawings.

In this respect, before explaining the current embodiments of the playground for handicapped children in detail, it is to be understood that the playground for handicapped children is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the playground for handicapped children.

It is therefore important that the claims be regarded as including such equivalent construction insofar as they do not depart from the spirit and scope of the playground for handicapped children. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
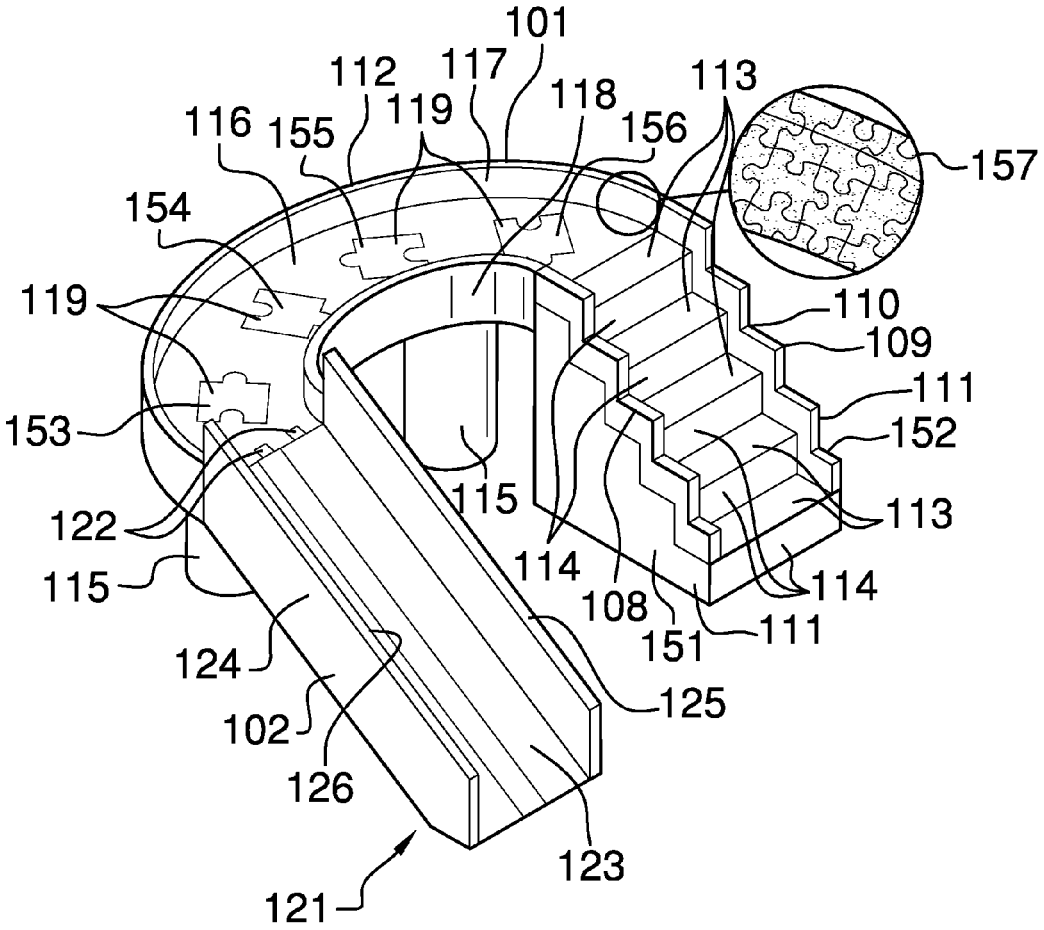
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In the specification and claims, the following definitions will be used:

Traditional Swing: As used in this disclosure, a swing is a seat suspended by lines, which are usually ropes or chains, on which someone may sit and swing back and forth.

Platform: As used in this disclosure, a platform is a raised surface upon which people can stand or sit.

Slide: When used as a verb in this disclosure, to slide means to move along a smooth surface while maintaining continuous contact with the smooth surface. When used as a noun in this disclosure, a slide is a structure with a smooth sloping surface for that people or objects can slide down.

Pen: As used in this disclosure, a pen is a small enclosed area reserved for a specific use or activity.

Turret: As used in this disclosure, a turret is a curved section of a wall that projects away from a portion of a larger wall. The turret increases the surface area of both sides of the wall relative to a flat wall. The side of a turret with the greater surface area is the "outer" side of the turret. The side of the turreted wall with the lesser surface area is the "inner" side of the turret. If both sides of the wall have the same surface area, the wall is "flat".

Detailed reference will now be made to a first potential embodiment of the disclosure, which is illustrated in FIGS. 1 through 6.

The playground for handicapped children 100 (hereinafter invention) comprises a bridge 101, a slide 102, a swing set 103, and a ball pen 104. The bridge 101 comprises a flight of stairs 110, a balcony 112, and a musical system.

Figure 2:
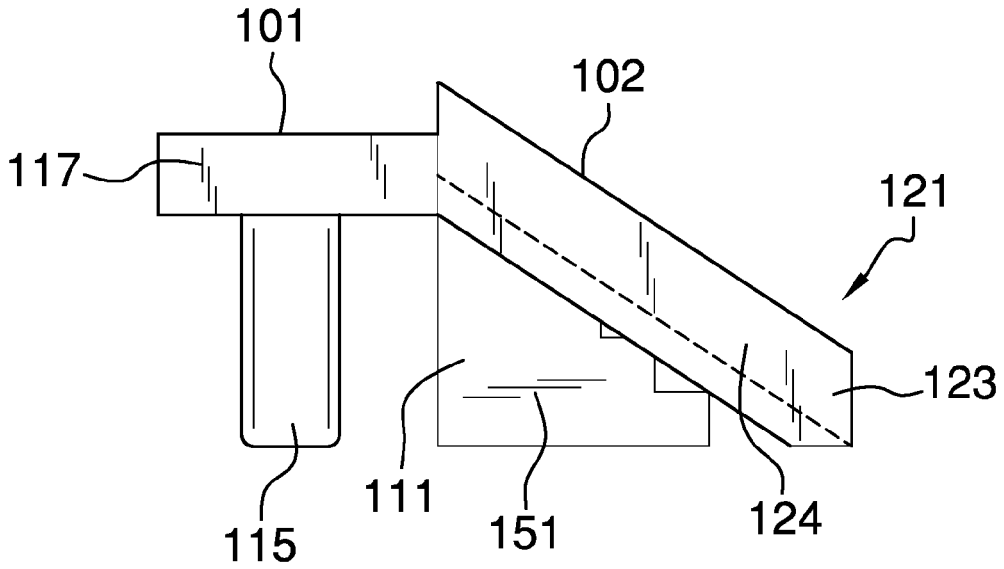
FIG. 2 is a side view of an embodiment of the disclosure.

The flight of stairs 110 comprise a plurality of stringers 111, a plurality of treads 113, a plurality of risers 114, a first banister 108, and a second banister 109. As shown in FIG. 2, each of the plurality of treads 113 is the horizontal surface that is stepped on by the person climbing the flight of stairs 110. Each of the plurality of risers 114 are used to close the open vertical space between each of the plurality of treads 113. The plurality of stringers 111 are the structural members that support the plurality of treads 113 and the plurality of risers 114. At a minimum, the flight of stairs 110 requires a first stringer 151 and a second stringer 152 to support each end of the plurality of treads 113. Additional stringers 111 can be placed between the first stringer 151 and the second stringer 152 to provide additional support for the plurality of treads 113 and plurality of risers 114.

The first banister 108 and the second banister 109 are solid surfaces that extend vertically upward from the plurality of treads 113 to enclose the sides of the flight of stairs 110. The purpose of the first banister 108 and second banister 109 is to provide the user with a handhold while climbing the flight of stairs 110 as well as to prevent users from falling off the side of the flight of stairs 110.

Methods to make a flight of stairs 110 are well known and documented in the art. The flight of stairs 110 can made from a combination of wood, metal, or plastic. The exterior surfaces of the flight of stairs 110 are made of, or covered in, an elastic plastic material that will deform under force and then return to the original shape after the force is removed. Suitable elastic plastic materials include, but are not limited to, polyurethane foam.

The balcony 112 comprises a balcony support structure 115, flooring 116, a first balcony wall 117, and a second balcony wall 118, and a plurality of pressure sensitive tiles 119. The balcony 112 is a platform that is raised off the ground that is attached to the flight of stairs 110 and the slide 102 and is otherwise enclosed by the first balcony wall 117 and the second balcony wall 118. The purpose of the balcony 112 is to provide user access from the flight of stairs 110 to the slide 102. The balcony support structure 115 is the foundation upon which the flooring 116, a first balcony wall 117, and a second balcony wall 118 are supported and that raises the flooring 116, first balcony wall 117, and second balcony wall 118 above the ground. The balcony 112 is raised above the ground so that the flooring 116 of the balcony 112 is raised high enough to act as the upper landing of the flight of stairs 110 and to provide convenient access to the upper end of the slide 102. The first balcony wall 117 and the second balcony wall 118 are walls that are intended to keep users safe by preventing users from falling off the balcony 112. The first balcony wall 117 and the second balcony wall 118 project perpendicularly from the flooring 116 in the direction away from the ground. The flooring 116 is the surface upon which users stand when on the balcony 112.

Fitted into the flooring 116 is a plurality of pressure sensitive tiles 119. Each of the plurality of pressure sensitive tiles 119 is fitted with an electric switch that closes when pressure, such as from the weight of a person, is applied to the surface of the pressure sensitive tiles 119. The closure of electrical switch is used to activate the musical system.

Methods to make platforms and balconies 112 are well known and documented in the art. The balcony 112 can made from a combination of wood, metal, or plastic. The exterior surfaces of the balcony 112 are made of, or covered in, an elastic plastic material that will deform under force and then return to the original shape after the force is removed. Suitable elastic plastic materials include, but are not limited to, polyurethane foam.

Each of the plurality of pressure tiles 119 can be commercially purchased or made by mounting a tile on a commercially available foot switch, which is then fitted into the flooring 116.

The musical system comprises one or more speakers, an amplifier, one or more musical sources, and a control device. The purpose of the speaker is to convert electrical signals into audible sounds, such as music. The purpose of the amplifier is to take the electrical signals generated from the music source, amplify these electrical signals and transmit the amplified electrical signals to the speaker. Each of the one or more music sources is a device that stores the electrical signal of the music to be generated for use by the amplifier. The purpose of the control device is to activate the music system and to select the music to be generated once the electric switch in one of the plurality of pressure tiles 119 is closed.

Figure 3:
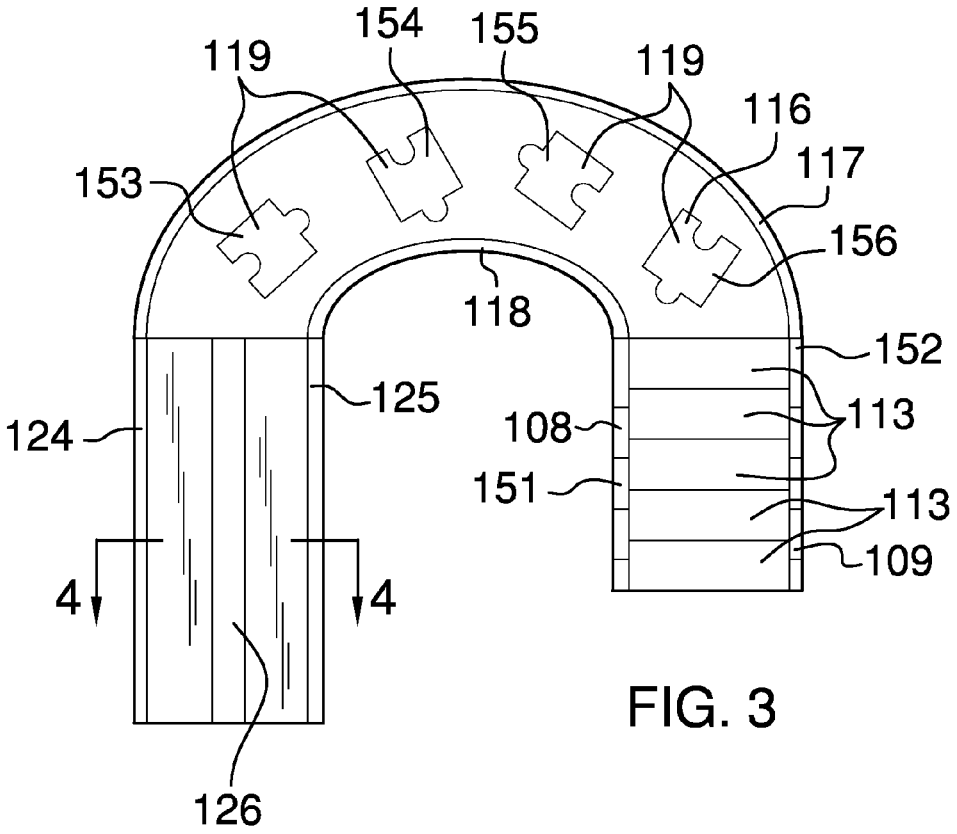
FIG. 3 is a top view of an embodiment of the disclosure.
Figure 4:
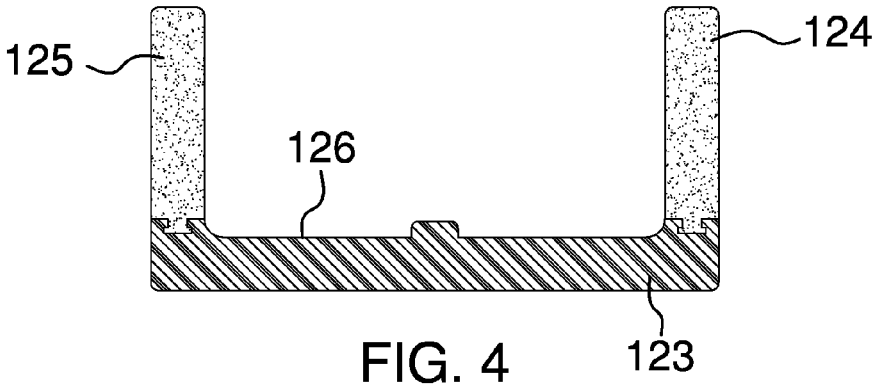
FIG. 4 is a detail view of an embodiment of the disclosure.

In a first potential embodiment of the disclosure, as illustrated in FIG. 3, the musical system comprises one speaker, one amplifier, a first music source associated with a first pressure tile 153, a second music source associated with a second pressure tile 154, a third music source associated with a third pressure tile 155, and a fourth music source associated with a fourth pressure tile 156. In the first potential embodiment of the disclosure, the electrical switches in the first pressure tile 153, second pressure tile 154, third pressure tile 155 and fourth pressure tile 156 are monitored by the control system. When the electrical switch of a pressure tile 119 is closed, the control system activates the music source associated with the specific pressure tile 119, which sends the appropriate electrical signal to the amplifier.

Speakers, amplifiers, and musical sources are commercially available. Methods to monitor the electrical switches in the pressure tiles and to use these signals to control speakers, amplifiers and music sources are well known and documented in the art. The musical system is mounted underneath the flooring of the balcony.

The slide 102 comprises a chute 121 and a slide structure 122. The chute 121 comprises a chute platform 123 and a first chute wall 124 and a second chute wall 125. The chute platform 123 is formed with a smooth upper surface 126 upon which the user can slide. The first chute wall 124 and the second chute wall 125 are walls intended to keep users safe when sliding down the slide 102 by preventing the users from falling over the sides. The first chute wall 124 and the second chute wall 125 are attached to the chute platform 123 such that the first chute wall 123 and the second chute wall 124 project perpendicularly from the chute platform 123 in a direction away from the ground. The slide structure 122 supports the chute platform 123 so that the first end of the chute platform 123 is level with the balcony 112 and the second end of the chute platform 123 is between approximately 0 and 24 inches above the ground. This results in the smooth upper surface 126 of the chute platform 123 being sloped or inclined.

The slide structure 122 can take three forms.

In a second potential embodiment, the slide structure 122 can be comprised of a first post, second post, third post and fourth post. In the second potential embodiment: the first post and second post are of equal length; the third post and fourth post are of equal length; and, the length of the first post is greater than the length of the third post. The first post and second post are attached to the first end of the chute platform 123. The third post and fourth post are attached to the second end of the chute platform 123. The slide 102 is then moved next to, and attached, to the balcony 112.

In a third potential embodiment, the first chute wall 124 and the second chute wall 125 are extended towards the ground to perform the function of the slide structure 122. In the third potential embodiment, the extended first chute wall 124 and the second chute wall 125 perform a function similar to stringers in a stair case by supporting the chute platform 123 at a slope or incline.

In a fourth potential embodiment, illustrated in FIGS. 1 and 2, the function of the slide structure 122 is performed by connectors that securely attach the first end of the chute platform 123 to the balcony 112. In the third potential embodiment, the balcony 112 supports the first end of the chute platform 123 while the second end of the chute platform 123 rests on the ground.

Methods to make a slide 102 are well known and documented in the art. The slide 102 can made from a combination of wood, metal, or plastic. With the exception of the smooth upper surface 126, the exterior surfaces of the slide 102 are made of, or covered in, an elastic plastic material that will deform under force and then return to the original shape after the force is removed. Suitable elastic plastic materials include, but are not limited to, polyurethane foam.

The swing set 103 comprises a plurality of supports 131, a crossbeam 132, one or more wheelchair swings 133 and, optionally, one or more traditional swings 134. The purpose of the crossbeam 132 is to provide a structure from which the one or more wheelchair swing 133 and the optional one or more traditional swings 134 may be suspended. The crossbeam 132 is raised above the ground using the plurality of supports 131. One or more wheelchair swings 133 and optionally, one or more traditional swings 134 are then suspended above the ground using two lines 135 per wheelchair swing or per optional traditional swing. The two lines 135 can be made or rope, wires, or chains.

Figure 5:
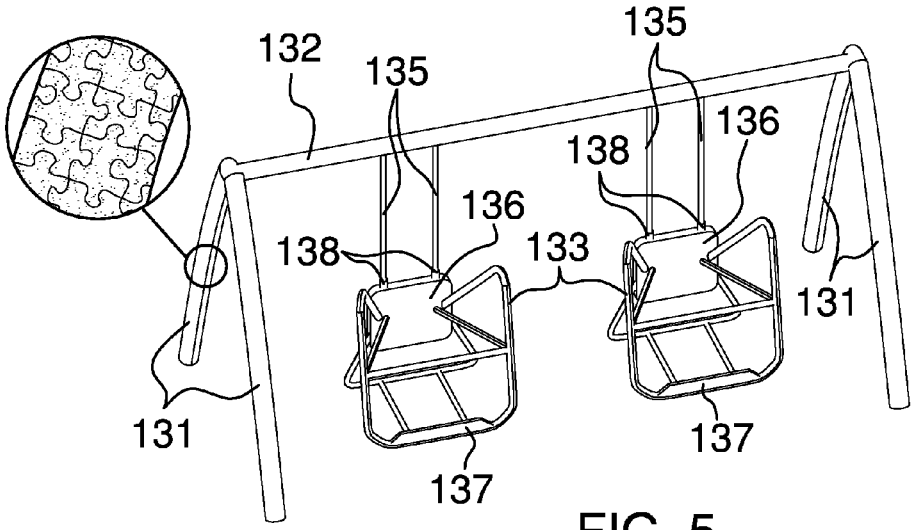
FIG. 5 is an alternate perspective view of an embodiment of the disclosure.
Figure 6:
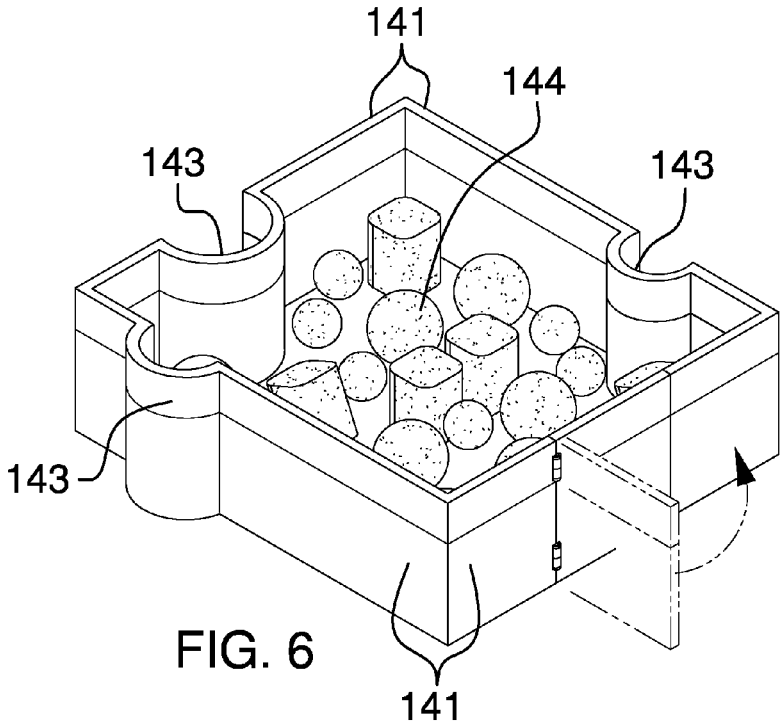
FIG. 6 is an alternate perspective view of an embodiment of the disclosure.
Figure 7:
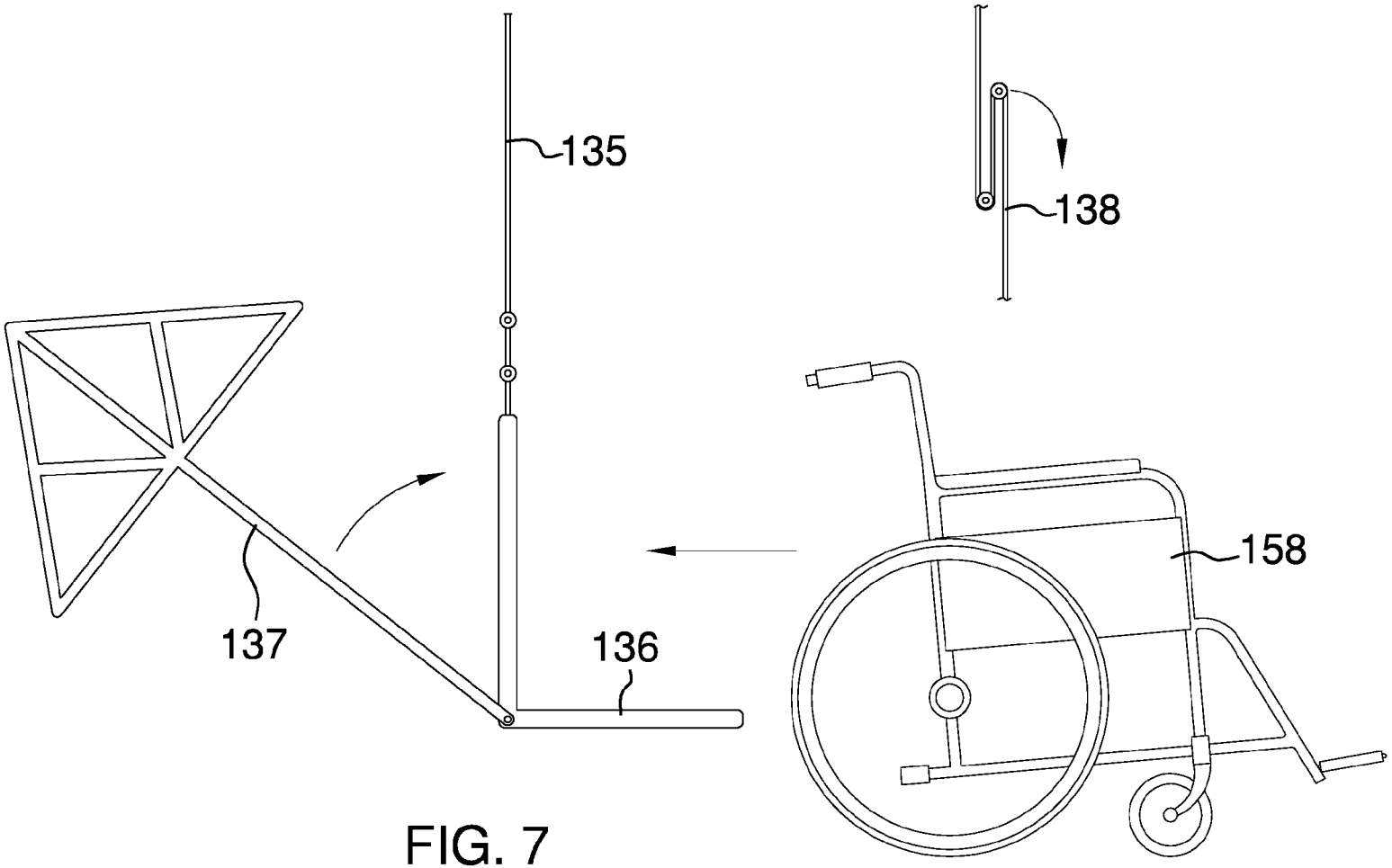
FIG. 7 is an in-use view of an embodiment of the disclosure.
Figure 8:
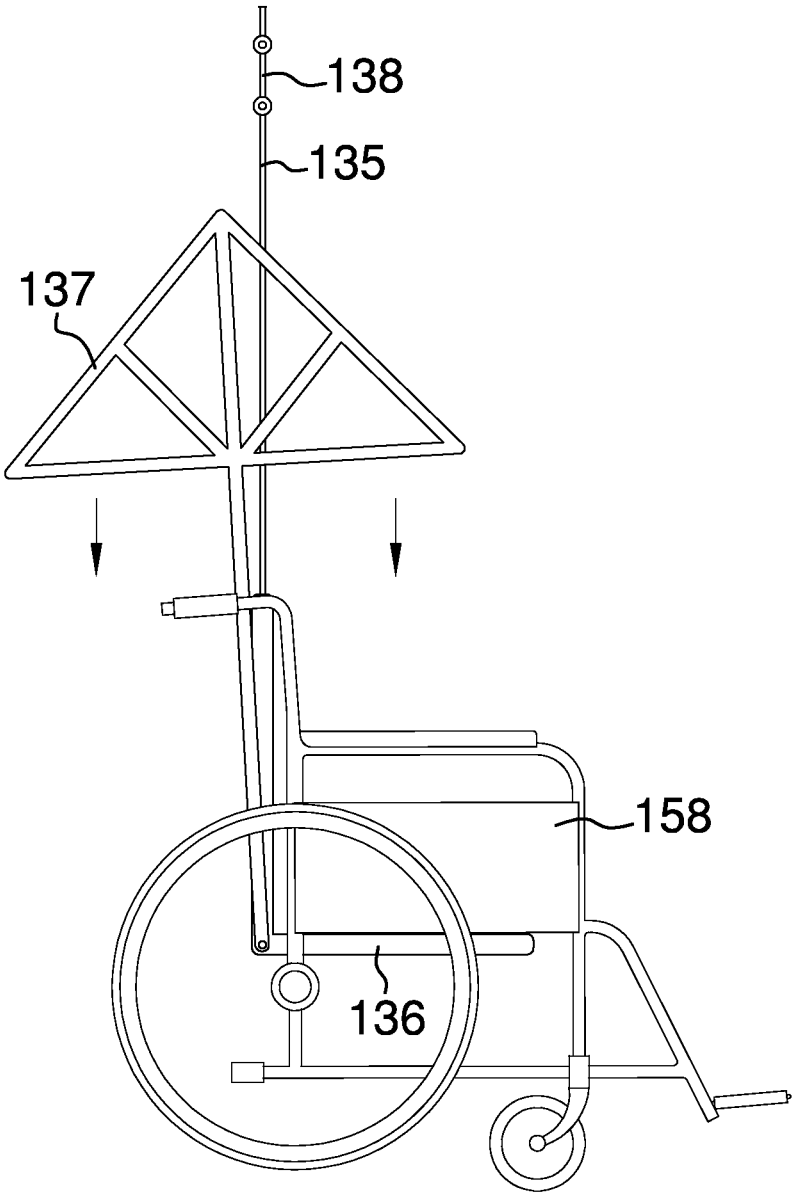
FIG. 8 is an alternate in-use view of an embodiment of the disclosure.

Each of the one or more wheelchair swings 133 comprises an L brace 136, a locking mechanism, two locking hoists 138. The L brace 136 is an L shaped support. The bottom side of the L brace 136, which runs parallel to the ground, is inserted underneath the seat of the wheelchair 158 to support the wheelchair 158 from underneath. The back side of the L brace 136, which runs perpendicular to the ground, supports the back side of the wheelchair 158. Once wheelchair 158 is set in the L brace 136, it is locked in place using a locking mechanism. This locking mechanism can be: 1) tie downs that secure the wheelchair 158 to the L brace 136; 2) hardware such as a U bolt that locks the tubes of the wheel chair to the two lines 135 or the L brace 136; or 3) as shown in FIGS. 5, 7, and 8, a frame 137 that is attached to the L Brace and that can be fitted over the wheelchair 158. Once the wheelchair 158 is locked into position, the each of the two locking hoists 138 are used raise the wheelchair 158 above the ground. The locking hoists 138 can be a pulley or block and tackle mechanism mounted on the crossbeam 132 that allows the wheelchair 158 to be raised. The excess line could then be tied off on the L brace 136. Alternatively, the locking hoist 138 can be a commercially available ratcheting mechanism designed to take up slack in ropes, cables, or chains. The locking hoist 138 can be manually operated or electrically powered.

The L braces, locking mechanisms and locking hoists are well known and documented in the industry. The L brace can be made from a combination of metal and plastic. Commercially available locking mechanisms can be used or a locking mechanism can be fabricated from metal pipes. The locking hoists are made from commercially available hardware.

The ball pen 104 is a segregated area that is filled with a plurality of foam balls 144 that allow the children to improve their hand strength and motor skills. The ball pen 104 comprises a plurality of pen walls 141, a door 142, and one or more optional turrets 143. The plurality of pen walls 141 are used to enclose the space. The door 142 is a hinged door that allows users access to the ball pen 104. The one or more optional turrets 143 are decorative features that are added give the ball pen 104 a more festive feel. The pen is then filled with a plurality of foam balls 144 and, optionally, other foam items to provide entertainment for the users.

Methods to make pens are well known and documented in the art. The ball pen 104 can made from a combination of wood, metal, or plastic. The exterior surfaces of the ball pen 104 are made of, or covered in, an elastic plastic material that will deform under force and then return to the original shape after the force is removed. Suitable elastic plastic materials include, but are not limited to, polyurethane foam. Foam balls 144 and other foam items are commercially available.

Optionally throughout the invention, the elastic plastic material that will deform under force and return to the original shape can be formed into the shape of interlocking puzzle pieces to provide further entertainment for the users.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A playground for handicapped children comprising a bridge, a slide, a swing set, and a ball pen;

wherein the bridge comprises a flight of stairs, a balcony, and a musical system;

wherein the slide comprises a chute and a slide structure;

wherein the swing set comprises a plurality of supports, a crossbeam, one or more wheelchair swings;

wherein the ball pen comprises a plurality of pen walls, a door, and a plurality of foam balls;

wherein the flight of stairs comprise a plurality of stringers, a plurality of treads, a plurality of risers, and a first banister and a second banister;

wherein the balcony comprises a balcony support structure, flooring, a first balcony wall, and a second balcony wall, and a plurality of pressure sensitive tiles;

wherein each of the plurality of pressure sensitive tiles is fitted with an electric switch that closes when pressure is applied to the surface of the pressure sensitive tiles;

wherein a control device activates the music system and to select the appropriate music once the electric switch in one of the plurality of pressure tiles is closed;

wherein the chute comprises a chute platform, a first chute wall, and a second chute wall;

the chute platform is formed with a smooth upper surface upon which the user can slide;

the first chute wall and the second chute wall are walls intended to keep users safe when sliding down the slide by preventing users from falling off the slide;

each of the one or more wheelchair swings comprises an L brace, a locking mechanism, and one or more locking hoists;

the L brace is an L shaped support;

the bottom side of the L shaped brace slides underneath the seat of the wheelchair to support the wheelchair from underneath;

the back side of the L brace supports the back side of the wheelchair;

the wheelchair is locked in place using a locking device;

each of the one or more locking hoists are used raise the wheelchair above the ground.

* * * * *